United States Patent [19]

Tooley

[11] 4,122,645

[45] Oct. 31, 1978

[54] APPARATUS FOR USE IN BUILDINGS

[75] Inventor: Jack R. Tooley, Cobham, England

[73] Assignee: Acrow (Engineers) Limited, London, England

[21] Appl. No.: 774,820

[22] Filed: Mar. 7, 1977

[30] Foreign Application Priority Data

Apr. 27, 1976 [GB] United Kingdom ..... 17054/76
Nov. 10, 1976 [GB] United Kingdom ..... 46810/76

[51] Int. Cl.[2] ..... E04G 17/14

[52] U.S. Cl. ..... 52/648; 52/126; 249/210; 249/18; 248/354 S

[58] Field of Search ..... 52/648, 126; 249/13, 249/18, 26, 28–32, 187–188, 205, 207, 210; 248/354 R, 354 S

[56] References Cited

U.S. PATENT DOCUMENTS 3,409,266 11/1968 Jennings ..... 52/648 X

*Primary Examiner*—J. Karl Bell
*Attorney, Agent, or Firm*—Wood, Herron & Evans

[57] ABSTRACT

An attachment for a builder's prop, scaffold pole of the like comprising a stem screw-threaded along at least a portion of its length and provided at one end with a top bearer plate, an intermediate bearer plate being mounted on a tubular sleeve which is slidable along the stem and adjustably positionable thereon by means of a nut engaging the screw thread, means being provided for preventing rotation of the sleeve around the stem as the nut is rotated to alter the position of the sleeve along the length of the stem.

7 Claims, 3 Drawing Figures

APPARATUS FOR USE IN BUILDINGS

Figure 1:
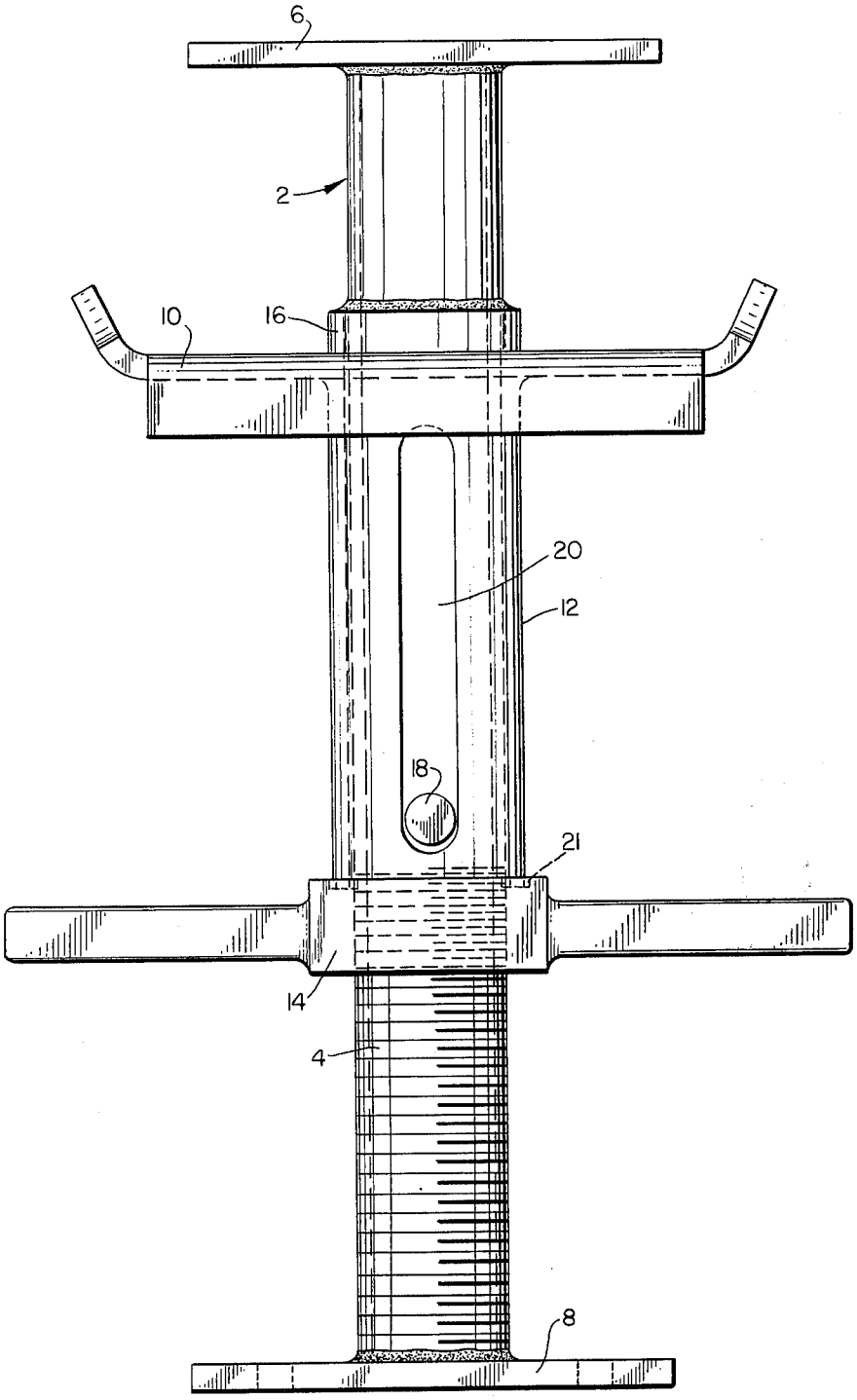

This invention relates to formwork for concrete and is an improvement or a modification of the invention forming the subject of our British Pat. No. 1,427,518.

Concrete floors and the like may well take a considerable time — a number of weeks for example — before they are fully cured, during which time they need to be supported. It is desirable to be able to re-use equipment as quickly as possible and this has tended to lead to an undesirable practice of dismantling the formwork system of shutters and props from only partially cured concrete e.g. after several days, removing the shutters for re-use and replacing the props to support the floor until the concrete has properly cured. This naturally leads to undesirable stresses in the concrete before it is properly cured whilst the props are removed and may lead to further undesirable stresses due to over tightening the props on replacement.

British Pat. No. 1,427,518 is directed to a prop attachment for supporting formwork shuttering comprising a stem screw-threaded along at least a portion of its length and provided at one end with a top transverse bearer plate, intermediate and lower transverse bear plates being mounted on and slidable together along the stem and being adjustably positionable thereon by means of a nut engaging with the screw thread. The lower bearer plate is preferably slidably mounted on the stem by means of a tubular sleeve.

Use of such an attachment on a prop enables shuttering members supported by the bearer plates to be lowered after preliminary curing of a concrete slab cast over the shuttering, and removed for use elsewhere leaving the partially cured concrete still supported at intervals, by the top bearer plates of the props.

Such a prop attachment is improved or modified in accordance with this invention by the presence of means (e.g. a pin sliding in a slot) to prevent rotation of the sleeve around the stem. Further the presence of the intermediate bearer plate is no longer essential.

The prop to which the attachment may be secured in use, is preferably so made as to enable its length to be adjusted. For example, it may be in two sections, one slidable within the other, the outer section (which is normally the lower positioned section in use) being provided with a number of holes spaced along its length, the overall length of the prop being set by securing a pin in a desired one of the holes so that it passes also through a hole in the inner or upper section or so that the lower end of the inner section abuts the pin.

In order to allow fine adjustment of the length of the prop and hence of the height of the upper bearer plate from the ground the screw threaded portion of the upper attachment may extend slidably into a socket in the upper end of the prop (which may be tubular), a second nut, below the first, bearing on the upper end of the prop.

Alternatively the prop may be provided with screw length-adjusting means in which case it and the attachment may be flange coupled by means of respective plates welded to the ends of the members, the plates being bolted together.

The uppermost position of the lower bearer plate may be limited for example by a collar.

In use, shuttering is supported by the lower bearer plate and, after preliminary curing of the concrete, the shuttering may be removed by lowering the lower bearer plate leaving the partially cured floor supported by the top bearer plate.

It will be appreciated that the attachment of this invention could be used to support members other than those for formwork shuttering and indeed may itself be supported by a fixed support or stut e.g. a scaffold member and not only by the adjustable props. For example, a framework might support a plurality of separate platforms or paths over a site between which one or more bridges are occasionally required. The requisite number of attachments may be incorporated in or supported by, the framework and the bridge supported on the transverse bearer plates. Such a bridge may then easily assembled and dismantled at a chosen location without the framework itself needing to be adjusted, merely by lowering the transverse bearing plates.

Figure 2:
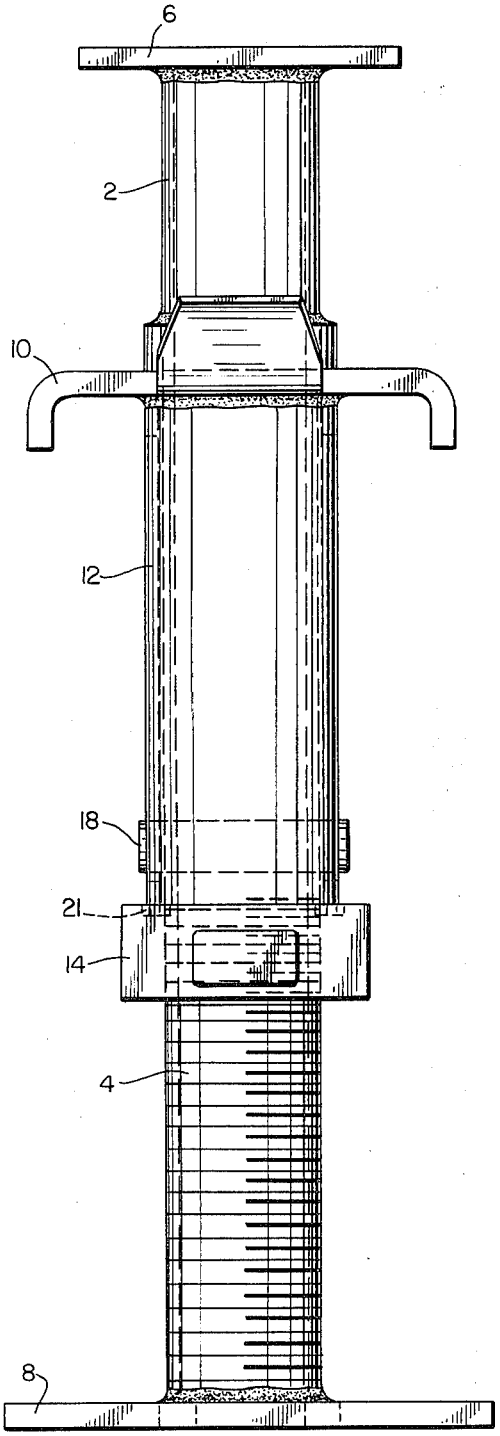
Figure 3:
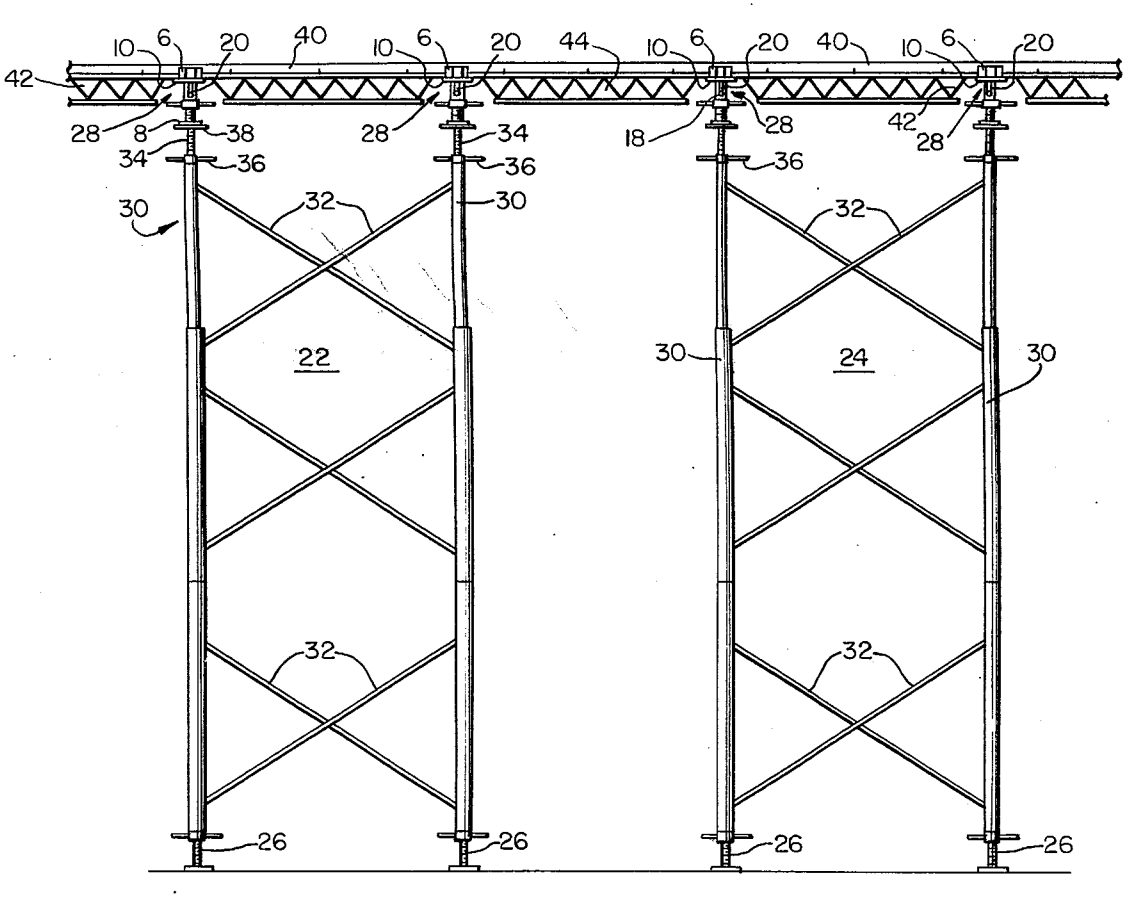

The invention will now be described by way of example with reference to the accompanying drawings in which:

FIG. 1 is an elevation of one embodiment of prop attachment in accordance with the invention, FIG. 2 is a corresponding view to FIG. 1 but taken at right angles thereto, and FIG. 3 is a front elevation of a prefabricated framework incorporating attachments in accordance with the invention.

Referring to FIGS. 1 and 2 of the drawing the prop attachment comprises a stem 2 threaded over its lower portion 4 and provided with a top transverse bearer plate 6 at its upper end. The lower end of the stem is provided with a fixing plate 8 to be bolted to the top plate of a standard builders adjustable prop.

A lower transverse bearer plate 10 is carried by a sleeve 12 slidably mounted on the stem 2 and resting on the upper surface of a nut 14 which is screw-threadedly engaged with the screw portion 4 of the stem. The position of the lower bearer plate 10 may be adjusted relative to the top bearer plate 6 by turning the nut 14.

A collar 16 is welded to the stem 2 above the bearer plate 10 to limit the upward movement of the plate.

A pin 18 extends out from the stem 2 and engages in longitudinal slots 20 formed in each side of the sleeve 12 the arrangement being such that the sleeve 12 can rise and fall relatively to the stem 2 on adjustment of the nut 14, but cannot turn relatively to the stem.

The nut 14 is formed with a recess 21 in which the lower end of the sleeve 12, engages. This recess helps to align the sleeve with the stem 2 and helps to prevent the sleeve and hence the bearer plate 10 from wobbling.

In use the overall height of a series of builders' props to which the attachment is secured is adjusted to bring the top bearer plates 6 to substantially the height of the underside of the floor or the like to be cast. Support beams (not shown) are laid between pairs of adjacent lower bearer plates 10 and shuttering panels are laid across between pairs of beams. The nuts 14 are then adjusted to bring the top of the panels level with the top support plates 6.

Concrete may then be poured in the usual manner over the panels and over the plates 6. When the concrete is partially cured, the nuts 14 may be screwed downwardly on the screwed stem portions 4 so as to lower the bearer plates 10 and the beams and shuttering panels supported thereby. The beams and shuttering panels may then be removed for re-use leaving the props in position with the top bearer plates supporting the partially cast floor.

FIG. 3 shows attachments in accordance with this invention when used with a fixed support frame as compared with FIGS. 1 and 2 which show the attachment connected to a single adjustable prop.

Two prefabricated framework supports are generally indicated at 22 and 24 in FIG. 3 each being mounted on ajustable screw-jack feet 26. Attachments, generally indicated at 28 and similar to those described with reference to FIGS. 1 and 2 are mounted on the top of each of the vertical members 30 of the framework.

Each framework support comprises four upright tubes 30 connected by cross braces 32 so that each support is in a form of a self-sustaining rectangular pillar. Each tube member 30 has a screwed rod 34 engaged in its open upper end, each screw 34 being provided with a nut 36 which rests on the top of the tube 30 and acts to support the rod 34 on the framework. The top of each screwed rod 34 is provided with a plate 38 to which the fixing plate 8 of each attachment 28 is secured by conventional bolts (not shown).

The height of each top bearer plate 6 of the attachments is adjusted by screwing nut 36 up and down the screw 34 until the plane of the bearer plates defines the required upper support surface. The transverse bearer plates 10 of the attachment which are movable with respect to the head plate 6 and support plate 8 act as support surfaces to hold a temporary structure.

Structural panels 40 are supported by beams 42 which are in turn supported on the bearer plates 10. A concrete floor may then be cast over the panel 40 as described hereinbefore with reference to FIGS. 1 and 2.

The space between the separate self-sustaining framework supports 22 and 24 may be bridged by a further beam 44 which is also supported on the plates 10 of adjacent attachments on the two framework structures and the beams 44 may either support additional panels 40 so that a complete floor is cast over the two framework supports and over the space there-between or alternatively the beam 44 may support a temporary bridge or gangway linking the two structures e.g. to facilitate delivery of the concrete. The gangway or bridge may then be dismantled after the concrete has been delivered by dropping the support plates 10 leaving an unimpeded passage between the two framework supports.

It will be appreciated that the surface or surfaces defined by the top plates of the attachments may be other than horizontal.

It will also be appreciated that the temporary bridge beam 44 could be supported by attachments in accordance with the invention which are themselves connected to and supported by, a solid support structure rather than connected to the framework illustrated.

As a further example the attachments of the invention may be secured not to a framework support as illustrated in FIG. 3 having adjustable height but may be secured directly to scaffold poles or the like forming part of any desired structure. The attachments will again enable a temporary structure to be supported and later removed whilst the main support structure remains in position.

What we claim is:

1. An attachment for a builder' s prop, said attachment being adapted to support at least one shuttering element of the type used with concrete formwork, said attachment comprising a stem having a top bearer plate fixed to the top end thereof and having screw threads provided on a portion thereof,said stem being connectable to said prop, a tubular sleeve having an intermediate bearer plate fixed thereto, said tubular sleeve being slidable relative to and coaxially disposed with said stem, and said intermediate bearer plate being adapted to support said shuttering element, nut means threadably engaged with the threaded portion of said stem, said tubular sleeve being received in seated relation on said nut means so that rotation of said nut means adjustably positions said tubular sleeve longitudinally of said stem, and a pin mounted on one of said stem and said sleeve, and a longitudinal slot defined in the other of said stem and said sleeve, said pin and said slot cooperating to prevent rotation of said sleeve relative to said stem as said sleeve is longitudinally repositioned relative to said stem by use of said nut means.

2. An attachment as claimed in claim 1 in which said pin is mounted on said stem and said slot is defined in said sleeve.

3. An attachment as claimed in claim 1, said attachment being fixed to a builder's prop, sand prop comprising a screw rod threadedly connected to the top end of a prop tube, said attachment being mounted on the top end of said screw rod, and a nut threaded onto said screw rod and bearing on the top end of said prop tube, rotation of said screw rod nut causing said attachment to be adjusted relative to said prop tube.

4. An attachment as claimed in claim 1, the uppermost position of said movable bear plate on said stem being determined by a collar secured to said stem.

5. An attachment as claimed in claim 1, the bottom and of said sleeve being seated in a recess defined in said nut.

6. Concrete form work comprising a number of adjustable props, each adjustable prop being provided at its upper end with an attachment as claimed in claim 1, the intermediate bearer plates cooperating to support beams which extend between adjacent attachments, and said intermediate bearer plate being positioned to support form work panels which have their casting surfaces aligned with the top surface of the top bearer plates.

7. Scaffolding structure having a number of attachments as claimed in claim 1, said structure including temporary support members connected between adjacent intermediate bearer plates of the attachments.

* * * * *